United States Patent [19]

Toyoda et al.

[11] 4,371,610

[45] Feb. 1, 1983

[54] PROCESS FOR DEVELOPMENT-PROCESSING SILVER HALIDE LIGHT-SENSITIVE MATERIAL

[75] Inventors: Takashi Toyoda; Isamu Itoh; Minoru Yamada, all of Minami-ashigara, Japan

[73] Assignee: Fuji Photo Film Co., Ltd., Kanagawa, Japan

[21] Appl. No.: 286,482

[22] Filed: Jul. 24, 1981

[30] Foreign Application Priority Data

Jul. 24, 1980 [JP] Japan ..... 55-101739

[51] Int. Cl.[3] ..... G03C 5/30

[52] U.S. Cl. ..... 430/445; 430/446; 430/488

[58] Field of Search ..... 430/963, 419, 420, 445, 430/452, 446, 453, 456, 464, 465, 466, 477–493, 355, 426

[56] References Cited

U.S. PATENT DOCUMENTS

| | | | |
|---|---|---|---|
| 3,173,789 | 3/1965 | King et al. | 430/419 |
| 3,212,892 | 10/1965 | von König et al. | 430/456 |
| 3,545,971 | 12/1970 | Barnes et al. | 430/355 |
| 3,623,872 | 11/1971 | Berthold et al. | 430/963 |
| 4,141,734 | 2/1979 | Lenoir et al. | 430/445 |

*Primary Examiner*—Mary F. Downey

*Attorney, Agent, or Firm*—Sughrue, Mion, Zinn, Macpeak & Seas

[57] ABSTRACT

A process for development-processing a silver halide black-and-white photographic light-sensitive material without silver stain and fog by the use of a developing solution which contains 0.1 mole/l or more of sulfite and at least one compound represented by the following general formula (I) or (II)

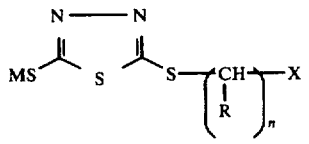

(I)

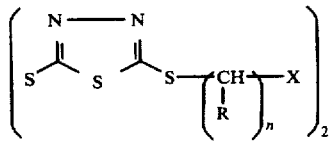

(II)

wherein M represents a hydrogen atom, an alkali metal atom or an ammonium group; R represents a hydrogen atom or an alkyl group having 1 to 4 carbon atoms; n represents an integer of 1 to 8; and X represents a sulfonic acid group, a sulfonate group, a carboxylic acid group or a carboxylate group.

8 Claims, No Drawings

PROCESS FOR DEVELOPMENT-PROCESSING SILVER HALIDE LIGHT-SENSITIVE MATERIAL

FIELD OF THE INVENTION

This invention relates to a process for development-processing a silver halide black-and-white photographic light-sensitive material and, more particularly, to a process in which silver sludge and fog, which have so far resulted from the use of a developing solution containing compound which dissolves the silver halide therein, especially a developing solution containing sulfites in a high concentration, are prevented from occurring.

BACKGROUND OF THE INVENTION

When a silver halide light-sensitive material is processed with a developing solution which contains a compound capable of dissolving silver halides, e.g., thiosulfates and sulfites, elution of a good deal of silver complexes from the sensitive material into the developing solution takes place. The silver complexes eluted into the developing solution are reduced with the developing agent and converted to fine metallic silver, resulting in the generation of silver sludge in the developing solution.

A developing solution which contains sulfite in a high concentration, especially in a concentration of about 0.1 mole/1 or above, has excellent quality in maintaining its developing activity upon storage. However, having once used, the developing solution tends to be contaminated and to cause developing-stain on surfaces of sensitive materials developed. This phenomenon turns out to be a serious disadvantage, especially in the case of high temperature development carried out using an automatic developing processor. This is because when development-processing is carried out using an automatic developing processor not only is silver sludge suspended in the developing solution but also silver particles adhere to walls of the processing tank and to rollers of the developing processor and thereby, sensitive materials are subject to contamination with silver deposited thereon in a form of roller streaks, the so-called silver stain, which silver turns yellow or brown by reflecting light therefrom. Silver stain is generated on the surface of a sensitive material equally, regardless of the quantity of light to which the sensitive material is exposed, and forms a colored layer on the surface resulting in a marked deterioration of image quality obtained. Namely, silver stain spoils directly the quality of the photographic image. Therefore, when photographic light-sensitive materials are processed with such a developing solution as described above using an automatic developing processor, the qualities of finished photographs are spoiled to a great extent.

As an inhibitor of silver sludge or liquid contamination, 2-mercapto-1,3,4-thiadiazoles (as described in British Pat. No. 940,169), 2-mercapto-1,3,4-oxadiazoles of 1-phenyl-5-mercaptotetrazole (as described in U.S. Pat. No. 3,173,789), D,L-6,8-dithiooctanoic acid (as described in U.S. Pat. No. 3,318,701), o-mercaptobenzoic acid (as described in British Pat. No. 1,144,481), aliphatic mercaptocarboxylic acids (as described in U.S. Pat. No. 3,628,955), L-thiazolidine-4-carboxylic acid (as described in *J. Photogr. Sci.*, volume 13, page 233 (1965)), disulfide compounds (as described in Japanese Patent Application (OPI) 36029/'77), 2-benzoxazolethiol and 2-benzimidazolethiol (as described in *Photogr. Sci. Eng.*, volume 20, page 220 (1976)), and so on are known.

However, none of the above-described compounds, in a photographic developing solution which is capable of dissolving silver halide, especially in a developing solution containing sulfite in a high concentration, functions as a sludge inhibitor effectively enough to provide satisfaction. For instance, aliphatic mercaptocarboxylic acid compounds are air oxidized and consequently, they tend to be oxidized in the air and lose rapidly their sludge preventing effects. In addition, some of these compounds have unpleasant odors. The use of 1-phenyl-5-mercaptotetrazole or 2-benzoxazolethiol in a large amount can reduce liquid contamination in some cases. However, in other cases these compounds react with silver ion to produce slightly soluble silver salts in the developing solutions and thereby, films are rather stained, rather than prevented silver stain. In addition, a large amount of such a compound in a developing solution disturbs the ability to achieve satisfactory photographic characteristics.

On the other hand, high temperature development, especially high temperature rapid processing using an automatic developing processor, is known as a process for carrying out development efficiently, and has proved fruitful upon the application to the processings of various kinds of sensitive materials. However, since sensitive materials are processed at high temperatures in this process, emulsion films under processing must be previously prevented from becoming brittle at high temperatures so as to have sufficient mechanical strength to withstand the stress applied thereto by rollers and belts of the automatic developing processor. Therefore, it is necessary to devise a technique to increase the mechanical strength of an emulsion film as the development in a developing solution progresses and further, may be kept there during the processing. For this purpose, the processing is carried out using a developing solution to which an aldehyde series hardener is added. According to this process, the total processing time can be shortened due to the processing at a high temperature, and the object of speeding up the processing can be attained so far as it goes. However, the development-processing with, e.g., developing solutions containing aldehydes, especially aliphatic dialdehydes, is attended by a marked generation of fog. The higher the temperature of the developing solution used is, and the longer the period of using the developing solution is, the more remarkable the tendency for the developing solution to cause fog becomes The occurrence of such fog resulting from aldehydes can be prevented by the use of a powerful fog restrainer, such as benzotriazole or 1-phenyl-5-mercaptotetrazole (which are described in L. F. A. Mason, *Photographic Processing Chemistry*, page 40 by THE FOCALPRESS, 1966) so far as it is concerned. On the other hand, the addition of such powerful fog restrainers to a developing solution retards the development to a great extent and thereby, the sensitivities of emulsions are reduced sharply.

5-Nitroindazole described in British Pat. No. 1,269,268 acts as an effective antifoggant in a developing solution containing an aldehyde series hardener, while it has the disadvantages that an appropriate solvent is required because of its poor solubility in a developing solution and its stability in a developing solution after the lapse of a long time is low.

Furthermore, satisfactory effect as a silver sludge inhibitor also is not exhibited.

SUMMARY OF THE INVENTION

Therefore, an object of this invention is to provide a process for development-processing a silver halide black-and-white light-sensitive material with a developing solution capable of dissolving silver halide especially a stable developing solution containing sulfite in a high concentration, using an automatic developing processor, in which process the developing solution is prevented from being contaminated with silver and the rollers and the belts of the automatic developing processor are also prevented from being stained with silver and therefore, photographic images free from silver stain and excellent in finished qualities are obtained.

Another object of this invention is to provide a process for development-processing, which process prevents the occurrence of silver sludge and silver stain in a developing solution for a silver halide black-and-white photographic light sensitive material.

A still another object of this invention is to provide a process for development-processing, in which marked generation of fog resulting from the use of a developing solution containing an aldehyde series hardener is reduced unaccompanied with sharp decreases in developing speed and emulsion sensitivity and where the developing solution does not produce any insoluble matter, is held stable for a considerably long period of time, and further does not generate silver sludge and silver stain.

A further object of this invention is to provide a process for development-processing, in which the above-described objects are all attained and where compounds having good solubilities to a developing solution are employed.

The above-described objects are attained by a process of processing a silver halide light-sensitive material with a developing solution which contains sulfite in a concentration of 0.1 mole/l or higher and at least one compound represented by the following general formula (I) or (II);

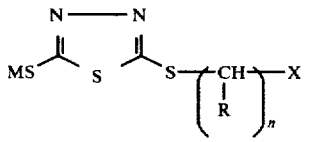

(I)

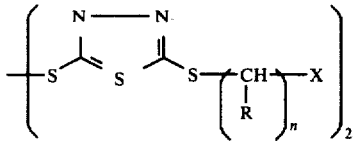

(II)

wherein M represents a hydrogen atom, an alkali metal atom or an ammonium group; R represents a hydrogen atom or an alkyl group having 1 to 4 carbon atoms; n represents an integer of 1 to 8; and X represents a sulfonic acid group, a sulfonate group, a carboxylic acid group or a carboxylate group.

DETAILED DESCRIPTION OF THE INVENTION

In the general formulae (I) and (II), which represent the compounds employable in this invention, alkali metal atoms represented by M include sodium, potassium and the like. Sulfonate and carboxylate groups represented by X are the salts of their respective acids and alkali metals, which alkali metals include sodium, potassium and the like, also. Alkyl groups represented by R include a methyl group, an ethyl group, a propyl group and the like. The compounds having the general formula (I) or (II) wherein X represents a sulfonic acid group or a sulfonate group are preferred because they exhibit greater effects on the prevention of silver sludge in a developing solution and the prevention of photographic fog.

Specific examples of such compounds are illustrated below. However, this invention is not intended to be construed as being limited to these examples.

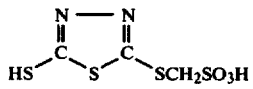

Compound (1)

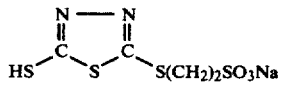

Compound (2)

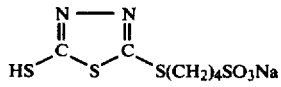

Compound (3)

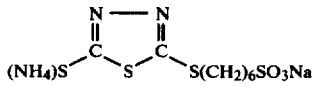

Compound (4)

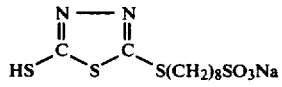

Compound (5)

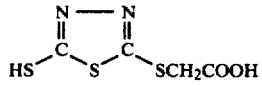

Compound (6)

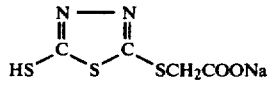

Compound (7)

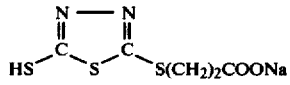

Compound (8)

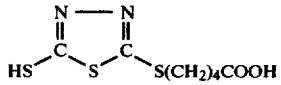

Compound (9)

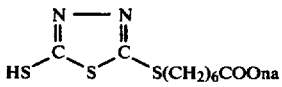

Compound (10)

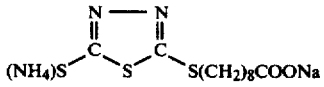

Compound (11)

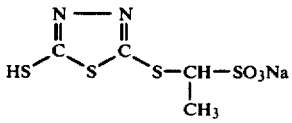

Compound (12)

-continued

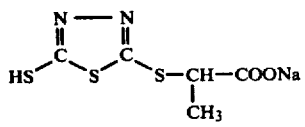

Compound (13)

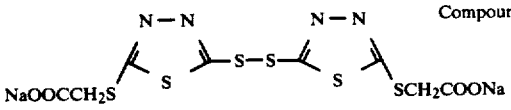

Compound (14)

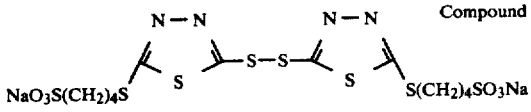

Compound (15)

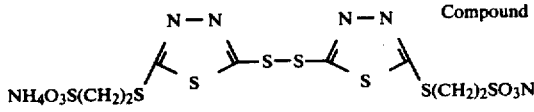

Compound (16)

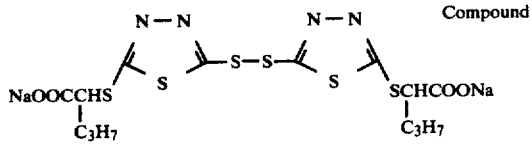

Compound (17)

Of these specific examples, Compounds (2), (3), (15) and (16) are preferred as the compound of this invention.

General methods for synthesizing these compounds are described in Japanese Patent Application (OPI) 102639/'76 and Japanese Patent Publication 35494/'73.

By the way, compounds described in Japanese Patent Publication 35494/'73 are equivalent to some of the compounds represented by the general formulae of this invention, and such compounds are employed as an inhibitor as an anomalous spotted fog caused by prehardening development-processing carried out using aldehydes mainly in a prehardening bath or a neutralizing bath. Accordingly, there is a difference in import between that previous invention and this invention utilizing such compounds in a developing solution containing a large amount of sulfite.

In addition, the compounds described in Japanese Patent Application (OPI) 102639/'76 are also equivalent to some of the compounds represented by the general formulae of this invention, and such compounds are employed in a developing solution as an antifoggant for color photographic light-sensitive materials which comprises silver halide emulsion layers containing non-diffusion couplers, and therefore the import of that invention in using them differs from that of this invention which employs them in a developing solution containing a large amount of sulfite.

The compound of the above-described general formula (I) or (II) is effectively added to the developing solution of this invention is an amount of 0.005 g to 5 g, and preferably 0.01 g to 1.0 g, per liter of developing solution.

Developing solutions employable in the development-processing of this invention are alkaline aqueous solutions containing conventionally used developing agents for black-and-white photography, alone or as a combination thereof. Specific examples of such developing agents include hydroquinone, alkylhydroquinones (e.g., t-butylhydroquinone, methylhydroquinone, dimethylhydroquinone, etc.), catechol, pyrazole, chlorohydroquinone, dichlorohydroquinone, alkoxyhydroquinones (e.g., methoxyhydroquinone and ethoxyhydroquinone), aminophenol series developing agents (e.g., N-methyl-p-aminophenol, 2,4-diaminophenol, etc.), ascorbic acid series developing agents, N-methyl-p-aminophenol sulfate, pyrazolones (e.g., 4-aminopyrazolone), 3-pyrazolidone series developing agents (e.g., 1-phenyl-3-pyrazolidone, 1-phenyl-4, 4-dimethyl-3-pyrazolidone, 1-phenyl-5-methyl-3-pyrazolidone, 1-phenyl-4-methyl-3-pyrazolidone, 1,5-diphenyl-3-pyrazolidone, 1-p-tollyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone and 3-acetoxy-1-phenyl-3-pyrazolidone), and so on.

In particular, combinations of hydroquinone and 3-pyrazolidones, or combinations of hydroquinone and aminophenols are very useful for rapid processing at high temperature, especially at 30° to 60° C.

The compounds represented by the general formula (I) or (II) of this invention exhibit their silver sludge preventing effect remarkably, particularly when employed in developing solutions containing a good deal of sulfite ions, such as ions derived from sodium sulfite, potassium sulfite, potassium metabisulfite and so on. In such the developing solution contains sulfite ion in a concentration of concretely about 0.1 mole or above, and preferably 0.2 mole to 1.0 mole, per liter of developing solution.

Silver sludge generated in the developing solution tends to be deposited particularly on the rollers and belts of an developing processor and to adhere thereto and the silver sludge attached to the rollers and the belts tends to stain sensitive materials. Therefore, the process of this invention is particularly effective for processing utilizing an automatic developing processor.

Examples of such an automatic developing processor include those of the opposed roll arrangement system (e.g., Pakorol Super G24-2produced by PAKO Co., Ltd., FG-14L, FG-24SQ and RN, produced by Fuji Photo Film Co., Ltd., etc.), those of zig-zag roll arrangement system (e.g., Kodalith Processor and M6Processor, produced by Eastman Kodak Co., RU produced by Fuji Photo Film Co., Ltd., etc.), those of the belt conveyer system (e.g., LD-241D produced by Log-E-tronics Co., Ltd., etc.) and others (e.g., Cronalith 24L produced by E.I. du Pont de Nemours, Co., etc.).

Moreover, bad fog resulting from processing with a developing solution which contains a good deal of sulfite ion and further an aldehyde series hardening agent, especially an aliphatic dialdehyde, can be prevented from occurring by the addition of the compound of this invention, without also a sharp reduction in developing speed. Simultaneously with the prevention of such bad fog silver sludge also almost completely prevented. Thereupon, such a hardening agent may be present in an amount of 1 to 20 g per liter of developing solution.

Examples of the hardening agents, include compounds having at least one aldehyde group, the sulfites thereof, and the hydrogensulfite adducts thereof. More specifically, formaldehyde, dimethylol urea, glyoxal, glutaraldehyde and the like can be employed.

In addition to the above-described agents, the developing solution may contain optionally a preservative (e.g., sulfites of alkali metals such as sodium sulfite, potassium sulfite, potassium metabisulfite and other sulfites of alkali metals), a buffer (e.g., carbonates, boric acid, borates and alkanolamines), an alkali agent (e.g., hydroxides and carbonates), a dissolving aid (e.g., polyethylene glycols and esters thereof), a pH adjusting agent (e.g., an organic acid such as acetic acid), a sensitizer (e.g., quaternary ammonium salts), a development accelerator, a surface active agent and so on.

An antifogging agent (e.g., 5-nitroindazole, 5-nitrobenzimidazole, benzotriazoles such as 5-methylbenzotriazole, 5-nitro-benzotriazole, etc., thiazoles such as benzothiazole, tetrazoles such as 1-phenyl-5-mercapto-tetrazole, the compounds described in British Pat. No. 1,269,268; and so on), and a chelating agent (e.g., ethylenediamine tetraacetic acid, alkali metal salts thereof, polyphosphates, and nitriloacetates) can be further incorporated into the developing solution.

The pH of the thus prepared developing solution is selected within a pH range that the desired density and contrast may be achieved in the image developed therein, and it is desirable for the pH to range from about 8 to 12, and particularly from about 9.0 to 10.5.

The development-processing temperature and development-processing time depend upon each other and they are determined depending upon the total processing time. Accordingly, the development-processing is generally carried out at a temperature of about 20° C. to 50° C. for a period of 10 seconds to 3 minutes. With high temperature rapid processing, a processing temperature of about 30° C. to 60° C. can be employed.

In this invention, a developing solution serves the purpose if only a complete set of the essential components are present at the time of use. Therefore, when a developing solution is prepared before processing, various components as described above for the developing solution may be employed in any forms, e.g., solid mixture, concentrate, solution, emulsion, suspension and so on. For example, ingredients to be used for preparing the developing solution may be separated into groups, and such groups may be kept separately in the same form or in different forms. On the other hand, the ingredients may be in the form of a previously prepared, powdery or liquid mixture.

At the time of its use, the prepared developer is optionally dissolved in water or diluted with water, and then used.

On the other hand, a fixing solution is, as described above, a water solution containing a thiosulfate and a water soluble aluminum compound, which is adjusted desirably to a pH of about 3.8 to 5.0 (at 20° C.). In the process of this invention although a stopping step can be provided after the developing step, the stopping step is generally omitted in a roll conveyer type automatic developing processor. Consequently, the developing solution is carried into the fixing solution, and the pH of the fixing solution increases. Therefore, it is desirable to adjust the pH of the fixing solution to about 3.8 to 4.6 (at 20° C.) in advance.

Thiosulfates such as ammonium thiosulfate, sodium thiosulfate and the like are employed, as a fixing agent and ammonium thiosulfate is particularly preferred in terms of fixing speed. The amount of a fixing agent used can be changed appropriately depending on circumstances, but it generally ranges from about 0.1 to 5 mole/1.

Water soluble aluminum salts which function principally as a hardening agent in a fixing solution are compounds known generally as a hardening agent for acid hardening fixing solutions, and they include, e.g., aluminum chloride, aluminum sulfate, potassium alum and the like.

In accordance with the process of this invention, photographic materials developed and fixed are washed with water and then, dried. The washing is carried out in order to remove almost completely silver salts dissolved in the fixing step, and it is desirable for the washing to be continued for 10 seconds to 3 minutes at a temperature of about 5° C. to 50° C. The drying is carried out at a temperature of about 40° C. to 100° C., and a drying time is changed appropriately depending upon the circumstances. However, the drying time may usually range from about 5 seconds to 3 minutes and 30 seconds.

Any types of sensitive materials can be processed using the process of this invention. However, it is preferable to apply this process to black-and-white sensitive materials, that is, X-ray sensitive materials, microfilms, sensitive materials for anlith sensitive materials for photo-composition, black-and-white sensitive materials for amateur photography, and so on. Silver halides of the light-sensitive layers may be silver chloride, silver chlorobromide, silver chloroiodobromide, silver bromide, silver iodobromide or so on. In addition, both negative type and direct positive type sensitive materials may be used in this invention.

The silver halide photosensitive materials applicable to the process of this invention comprise a support and at least one silver halide emulsion layer provided on the support. Not only can one side of the support be coated with a silver halide emulsion layer, but also the other side thereof may be coated with a silver halide emulsion layer. Of course, the sensitive material can have optionally a backing layer, an antihalation layer, an interlayer, a topmost layer (e.g., a protecting layer) and so on. The silver halide emulsions are dispersions of silver halide in hydrophilic colloids (e.g., gelatin, denatured gelatin, colloidal albumin, casein, carboxymethyl cellulose, hydroxyethyl cellulose, sodium alginate, polyvinyl alcohol, polyvinyl pyrrolidone or mixtures thereof). The silver halide emulsions are prepared by mixing water soluble silver salts (e.g., silver nitrate) and water soluble halides in the presence of water and hydrophilic colloids using conventional methods well known in this art (e.g., the single jet method, the double jet method, the controlled jet method and so on) and then, subjecting the resulting emulsion to both a physical ripening treatment and a chemical ripening treatments (e.g., gold sensitization and/or sulfur sensitization, and so on). Spectral sensitizers (e.g., cyanine dyes, merocyanine dyes or mixture thereof), stabilizers (e.g., 4-hydroxy-6-methyl-1,3,3a,7-tetrazaindene), sensitizers (e.g., compounds described in U.S. Pat. No. 3,619,198), antifoggants (e.g., benzotriazole, 5-nitrobenzimidazole, polyethylene oxide or the compounds described in Japanese Patent Application 79979/'71 (U.S. Pat. No. 3,813,250)), hardeners (e.g., formaldehyde, glyoxal, mucochloric acid, and 2-hydroxy-4,6-dichloro-s-triazine), coating aids (e.g., saponin, sodium laurylsulfate, dodecylphenol polyethylene oxide ether, and hexadecyltrimethylammonium chloride), and so on can be added to the silver halide emulsions, during preparation or just before coating. The thus prepared silver halide emulsion is coated on a support, such as a baryta paper, a resin coated paper, a cellulose acetate film, a polyethylene terephthalate film or so on, using the dip coating technique, the air knife coating technique, the bead technique, the extrusion doctor technique, the double coating technique or so on, and then dried.

The present invention is illustrated in greater detail by reference to the following examples. However, the invention is not intended to be construed as being limited to these examples. Unless otherwise indicate herein, all parts, percent ratios and the like are by weight.

EXAMPLE 1

Developing Solutions (A), (B) and (C) having the following compositions were prepared.

| | |
|---|---|
| Developing Solution (A) | |
| Sodium Sulfite | 67 g |
| Hydroquinone | 23 g |
| 1-Phenyl-3-pyrazolidone | 0.4 g |
| Potassium Hydroxide | 11 g |
| Sodium Carbonate (monohydrate) | 11 g |
| Potassium Bromide | 3.0 g |
| Water to make | 1 liter |
| pH adjusted to | 10.65 |
| Developing Solution (B) | |
| Developing Solution (A) | 1 liter |
| Compound (3) | 300 mg |
| pH measure | 10.65 |
| Developing Solution (C) | |
| Developing Solution (A) | 1 liter |
| Compound (7) | 300 mg |
| pH measured | 10.65 |
| The fixing solution used had the following composition. | |
| Composition of Fixing Solution | |
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 liter |
| pH adjusted to | 4.2 |

Using each of these developing solutions, the following processings were carried out.

The development-processing was achieved using the following steps in the order listed.

| | Processing Step | Temperature | Time |
|---|---|---|---|
| 1. | Developing | 38° C. | 20 sec. |
| 2. | Fixing | 38° C. | 20 sec. |
| 3. | Washing | 38° C. | 20 sec. |

A 22 liter portion of each of the developing solutions was placed in a roll conveyer automatic developing processor (FG-24SQ, produced by Fuji Photo Film Co., Ltd.). A black-and-white photographic film having a silver chlorobromide (silver chloride: 50 mole %) emulsion layer (silver content: 4 g/m$^2$) on a polyethylene terephthalate film was passed into the above-described developing processor after imagewise exposure, and was development-processed therein. The development-processing was carried out under the condition of a developing temperature of 38° C., a developing time of 20 seconds, and the developing solution was automatically supplemented with a 100 ml portion of replenisher for each development-processing of one film of 20 inch × 24 inch. One hundred films of the great whole paper size were development-processed over a period of 5 hours per day, and such an operation was continued for one week. In the case of the Developing Solution (A) where no compounds falling within the compound of the general formula (I) or (II) of this invention were present, the developing solution, which was originally colorless and transparent, began to become turbid at an early stage of the operation, and deposition of silver sludge was observed during only the first one hundred films' development-processing.

Under such conditions, striped silver stain began to appear on the films developed, and such stain became more and more serious as the development-processing was continued over a period of one week. A thick turbidity and deposition of silver sludge were observed in the developing solution, and on the rolls of the automatic developing processor considerable silver stain was present. In addition, striped silver stain on the film developed increased with the number of films passed through the development-processing using the same developing solution.

Further, abrasion, which appeared to be caused by contact with sludge adhered to the rolls, was observed on the surfaces of films.

On the other hand, Developing solutions (B) and (C) which contained therein Compounds (3) and (7) of this invention which were originally colorless and transparent, were entirely transparent even after one week's development-processing. Moreover, silver stain and abrasion were not observed at all on any surface of film developed. After the development-processing was further continued for another week, silver sludge was not noticed at all in Developing Solution (B), but a very small quantity of silver sludge was generated in Developing Solution (C). However, compared with Developing Solution (A), both Developing Solution (B) and Developing Solution (C) had much greater silver sludge prevention.

Additionally, Developing Solution (B) had a greater silver sludge preventing effect than Developing Solution (C).

EXAMPLE 2

X-ray films (trade name Fuji RX) which had received stepwise exposure using an optical wedge were subjected to high temperature rapid development-processing which included the following steps in the order listed, wherein the following six developing solutions were employed respectively.

| | Processing Step | Temperature | Time |
|---|---|---|---|
| 1. | Development | 35° C. | 25 sec. |
| 2. | Fixation | 35° C. | 25 sec. |
| 3. | Washing | 20° C. | 30 sec. |

| | |
|---|---|
| Developing Solution (A) | |
| 1-Phenyl-3-pyrazolidone | 1.5 g |
| Hydroquinone | 30 g |
| Sodium Sulfite (anhydrous) | 50 g |
| Potassium Hydroxide | 20 g |
| Boric Acid | 10 g |
| Glutaraldehyde (25% aq. solu.) | 20 ml) |
| Water to make | 1 liter |
| pH adjusted to | 10.20 |
| Developing Solution (B) | |
| Developing Solution (A) | 1 liter |
| Compound (2) | 100 mg |
| Developing Solution (C) | |
| Developing Solution (A) | 1 liter |
| Compound (3) | 100 mg |
| Developing Solution (D) | |
| Developing Solution (A) | 1 liter |

-continued

| | |
|---|---|
| Compound (7) | 100 mg |
| Developing Solution (E) | |
| Developing Solution (A) | 1 liter |
| 5-Nitroindazole (Compound described in British Patent 1,269,268) | 100 mg |
| Developing Solution (F) | |
| Developing Solution (A) | 1 liter |
| 1-Phenyl-5-mercaptotetrazole | 100 mg |

The pH of these Developing Solutions (B) to (F) was 10.20.

The Composition of fixing solution used is described below:

| | |
|---|---|
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 liter |
| pH adjusted to | 4.20 |

The Photographic characteristics attained are summarized in Table 1 below.

TABLE 1

| | Developing Solution | Fog | Relative Sensitivity (Fog + 1.0) | Gamma | Maximum Density |
|---|---|---|---|---|---|
| Comparison | A | 1.25 | 100 | 1.00 | 2.90 |
| This | B | 0.16 | 80 | 2.90 | 3.20 |
| Invention | C | 0.16 | 80 | 2.90 | 3.20 |
| | D | 0.16 | 80 | 2.75 | 3.10 |
| Comparison | E | 0.16 | 65 | 2.60 | 3.00 |
| | F | 0.14 | 10 | 1 | 2.00 |

Each of gamma values in Table 1 was determined from one intersection of their respective characteristic curve and a density line having a value of fog density plus 0.25, and another intersection of the characteristic curve and a different density line which had a value of the above-described density line value plus 1.75. In Developing Solution (B), (C) and (D) wherein the compounds of this invention were employed, fog was effectively prevented from occurring due to the presence of aldehydes but without a sharp decrease in sensitivity, and gamma values could be greatly increased, compared with Developing Solution (A) where no compounds of this invention were employed. Developing Solution (F), where 1-phenyl-5-mercapto-tetrazole was employed, had an antifogging effect, but decreased sharply the relative sensitivity. Therefore, Developing Solution (F) was not suitable for practical use.

Compared with Developing Solution (E), where 5-nitroindazole described in British Pat. No. 1,269,268 was employed, Developing Solutions (B), (C) and (D) caused generation of fog with nearly equal densities, but advantageous results regarding photographic characteristics were achieved in that the relative sensitivities, the gamma values and the maximum densities could be enhanced by about 20%, from 0.15 to 0.30, and from 0.1 to 0.20, respectively. Moreover, although 5-nitroindazole has a poor solubility in the developing solution and requires a certain solvent like glycols and further, has a low stability in the developing solution, the compounds of this invention have good solubilities in the developing solution and consequently, do not require any special solvent for dissolution into the developing solution and further, as described hereinafter, they have excellent stability in the developing solution.

Each of Developing Solutions (A) to (F) were again prepared and then separated into two portions just after preparation. One portion was immediately used for development-processing as described below, while the other portion was used after storage in a sealed container made of polyethylene, in which a gas, part of which was air, was enclosed, for a period of one week at a temperature of 40° C.

Each of the thus prepared, fresh and stored Developing solutions (A) to (F) was placed in a quantity of two liters in a roll conveyer type Fuji X-ray processor RE automatic developing processor (produced by Fuji Photo Film Co., Ltd.). X-ray films (trade name, Fuji RX) were development-processed in the above-described RE automatic developing processor after exposure. The development-processing was carried out under conditions of a developing temperature of 35° C., a developing time of 25 seconds per sheet of film, and the developing solution was automatically supplemented with a 25 ml portion of replenisher for each development-processing of one sheet of film having a size of 30.5 cm×25.4 cm. After one hundred sheet-form films were development-processed over a period of five hours, the results as summarized in Table 2 below were obtained.

TABLE 2

| Developing Solution | Fresh | Stored |
|---|---|---|
| (A) | Thick turbidity was generated and silver sludge was deposited after one day. | Thick turbidity was generated and deposited sludge increased in quantity. |
| (B) | The solution remained colorless and transparent, and sludge was not observed. | The solution remained colorless and transparent and sludge was not observed. |
| (C) | The solution remained colorless and transparent, and sludge was not observed. | The solution remained colorless and transparent and sludge was not observed. |
| (D) | The solution became slightly turbid, but sludge was not observed. | The solution became slightly turbid, but sludge was not observed. |
| (E) | The solution became turbid, and sludge was deposited after one day. | The solution became considerably turbid, and deposited sludge increased in quantity. |
| (F) | The solution became turbid, and sludge was deposited after one day. | The solution became turbid, and sludge was deposited in increased quantity. |

Developing solutions (B), (C) and (D), in which the compounds of this invention were employed, were highly effective for prevention of silver sludge, and it turned out that their effects remained unchanged even after storage for one week at 40° C.

Among these solutions, Developing Solutions (B) and (C) exhibited slightly stronger silver sludge preventing ability than Developing Solution (D).

On the other hand, Developing Solutions (E) and (F) in which 5-nitroindazole and 1-phenyl-5-mercaptotetrazole were employed, respectively, did not have satisfactory effects in prevention of silver sludge.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide black and white light-sensitive material comprising treating said material imagewise exposed with a developing solution which contains 0.1 mole/l or more of sulfite and at least one compound represented by the following general formula (I)

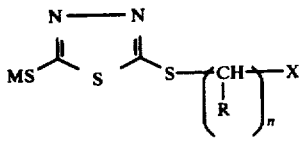

(I)

wherein M represents a hydrogen atom, an alkali metal atom or an ammonium group; R represents a hydrogen atom or an alkyl group having 1 to 4 carbon atoms; n represents an integer of 1 to 8; and X represents a sulfonic acid group, a sulfonate group, a carboxylic acid group or a carboxylate group.

2. The method as described in claim 1, wherein said developing solution contains an aldehyde hardener.

3. The method as described in claim 2, wherein said aldehyde hardener is a compound containing at least one aldehyde group selected from the group consisting of formaldehyde, dimethylol urea, glyoxal, and glutaraldehyde, a sulfite thereof or a hydrogensulfite adduct thereof.

4. The method as described in claim 1, wherein X in said general formula (I) is a sulfonic acid group or a sulfonate group.

5. The method as described in claim 1, wherein X in said general formula (I) is a carboxylic acid group or a carboxylate group.

6. The method as described in claim 1, wherein n in said general formula (I) is 2 or 4.

7. The method as described in claim 1, wherein said method comprises fixing said image-wise exposed and developed material.

8. The method as described in claim 1, wherein the developing solution contains an additional developing agent for developing a black and white light-sensitive material.

* * * * *